US005273272A

United States Patent [19]

Nakamura et al.

[11] Patent Number: 5,273,272

[45] Date of Patent: Dec. 28, 1993

[54] PAPER CASSETTE UNIT

[75] Inventors: Toshihisa Nakamura, Sagamihara; Yozo Matsuura, Tokyo; Yoshiya Ito, Atsugi, all of Japan

[73] Assignee: Ricoh Company, Ltd., Tokyo, Japan

[21] Appl. No.: 817,361

[22] Filed: Jan. 6, 1992

[30] Foreign Application Priority Data

Jan. 9, 1991 [JP] Japan ..... 3-1154

[51] Int. Cl.[5] ..... B65H 1/04

[52] U.S. Cl. ..... 271/167; 271/171

[58] Field of Search ..... 271/162, 163, 164, 145, 271/171

[56] References Cited

U.S. PATENT DOCUMENTS 4,378,154 3/1983 Hoffman ..... 271/164 X 4,697,803 10/1987 Kan ..... 271/164 X

FOREIGN PATENT DOCUMENTS 281097 9/1988 European Pat. Off. ..... 271/164

1-72128 7/1989 Japan ..... 271/164

*Primary Examiner*—Richard A. Schacher

*Attorney, Agent, or Firm*—Oblon, Spivak, McClelland, Maier & Neustadt

[57] ABSTRACT

A paper cassette unit includes a base part installed in an image forming system, a paper cassette having a compartment in which sheets of paper are accommodated, the paper cassette being detachably mounted in the base part, a cassette cover for covering an opening of the compartment when the paper cassette is mounted in the base part, and a connecting part connecting the cassette cover to the base part in such a way that only the cover stays in the base part when the paper cassette is demounted from the base part. The paper cassette unit also includes a size indicator for indicating size of the sheets of paper, the size indicator being detachably mounted in the paper cassette and having an integrally formed operating part including a set of projections corresponding to the indicated size, and a detection part for detecting the size of sheets of paper in use, the detection part having a set of switches depressed by corresponding projections of the operation part when the paper cassette is mounted in the base part.

7 Claims, 4 Drawing Sheets

PAPER CASSETTE UNIT

BACKGROUND OF THE INVENTION

The present invention relates generally to a paper cassette unit, and more particularly to a paper cassette unit which is detachably mounted in an image forming system and holds sheets of paper on which an image formed by the image forming system is recorded. This paper cassette unit is applicable to copiers, printers, facsimile machines, or the like.

Conventionally, an image forming system uses sheets of paper on which an image, for example, one reproduced from an original document, is recorded. A paper cassette unit includes a paper cassette in which the sheets of paper are accommodated, and is detachably mounted in the image forming system. When replenishment or exchange of sheets of paper is necessary an operator demounts the paper cassette unit from the image forming system, an replenishes the paper cassette with new sheets of paper, or replaces the paper cassette unit with another such unit containing sheets of paper of a different size.

FIG. 1 shows a conventional paper cassette unit detachably mounted in an image forming system. This paper cassette unit 1 shown in FIG. 1 includes a cassette cover 2 for covering an opening portion 1*a* of a paper cassette so as to keep the sheets of paper in the paper cassette free from external moisture or water. When the paper cassette unit is replenished with new sheets of paper or replaced with another paper cassette unit, the paper cassette unit 1 with the attached cassette cover 1*a* is demounted from the image forming system. The cassette cover 2 is detached from the paper cassette unit 1, the opening 1*a* of the paper cassette being open to the exterior. Once the paper replenishment or exchange is finished, the cassette cover 2 has to be attached to the paper cassette unit 1, in order to cover the opening 1*a*, and the paper cassette unit 1 with the attached cassette cover 2 has to be mounted again in the image forming system.

A paper cassette unit capable of holding plural sizes of sheets of paper requires a size detection member for giving information on paper size change to the image forming system when the previous sheets of paper in the paper cassette are replaced by new sheets of paper of a different size. The paper cassette unit of this type includes a paper cassette provided with a paper-size detection actuator and a paper size indicator, both separately attached to the paper cassette. When a paper size is changed, the paper-size detection actuator and the paper-size indicator in the paper cassette unit have to be also replaced by different ones. The paper-size detection actuator uses a width guide member formed in the paper cassette for detecting paper size, and this width guide member slides freely in the paper cassette in a direction of the width of inserted paper. Thus, the paper-size detection actuator can detect the size of the new paper in the paper cassette by means of the position at which the width guide member is set.

In a case in which the above conventional paper cassette unit is mounted in the image forming system, an operator may forget to attach the cassette cover 2 to the paper cassette when the replenishment or exchange of sheets of paper is carried out. When the paper cassette unit 1 is inadvertently mounted in the image forming system, with no cassette cover 2, the sheets of paper in the paper cassette are subjected to external moisture.

When the moist paper dries, it will be in a distorted or wavy condition, If such paper is used, in the image forming system, there is a problem in that two or more sheets of paper are erroneously fed by a paper feeding part of the image forming system, poor image transfer takes place at an image transfer part of the system, or the paper becomes corrugated due to heat generated by a fixing part of the system. Thus, the use of defective paper will cause reduce the quality of the performance of the image forming system. Also, with the conventional paper cassette unit, an operator is apt to perform unintentional operation when the paper-size detection actuator and the paper-size indicator are exchanged for changing paper size. Moreover, if the operator exchanged only one of the actuator and the indicator and did not exchange the other, or forgot to do so, a malfunction of the image forming system would occur due to the disparity, between the actuator and the indicator used therein, with respect to indicated paper size.

There is also a problem in that the above described paper cassette unit having the paper-size detection actuator and using the width guide member for paper size detection is of relatively large size and the cost of manufacture is high.

SUMMARY OF OF THE INVENTION

Accordingly, it is a general object of the present invention to provide an improved paper cassette unit in which the above described problems are eliminated.

Another and more specific object of the present invention is to provide a useful paper cassette unit in which replenishment or exchange of sheets of paper can be safely and easily made. The above mentioned objects of the present invention can be achieved by a paper cassette unit which includes a base part installed in the image forming system, a paper cassette having a paper compartment in which sheets of paper are accommodated for use in an image forming system, the paper cassette being detachably mounted in the base part, a cassette cover for covering an opening of the paper compartment when the paper cassette is mounted in the base part, and a connecting part for connecting the cassette cover to the base part in such a way that the cassette cover stays in the base part when the paper cassette is demounted from the base part. A still another object of the present invention is to provide a useful paper cassette unit which can easily and safely detect size of sheets of paper in a paper cassette. The above mentioned objects of the present invention can also achieved by a paper cassette unit which includes a base part installed in an image forming system, a paper cassette having a paper compartment in which sheets of paper are accommodated for use in the image forming system, the paper cassette being detachably mounted in the base part, a size indicator for indicating size of the sheets of paper in the paper cassette, the size indicator being detachably mounted in the paper cassette and having an integrally formed operating part including a set of projections corresponding to the paper size indicated by the size indicator, and a detection part for detecting the size of the sheets of paper in the paper cassette, the detection part having a set of switches being depressed by corresponding projections of the operating part when the paper cassette is mounted in the base part. According to the present invention, it is possible to eliminate the above-mentioned inadvertent operation of an operator in which the cassette cover is inadvertently not attached to the paper cassette, by means of a cassette cover that is automatically attached to the paper cassette when the paper cassette unit is mounted in the image forming system, and that is automatically detached from the paper cassette when the paper cassette unit is demounted therefrom. Therefore, the paper cassette unit of the present invention can be safely and easily replenished with paper, the paper therein can be safely and easily replaced with new sheets of paper of a different size. Also, according to the present invention, it is possible to easily and safely detect the size of sheets of paper in the paper cassette by means of the size indicator and the detection part provided therein.

Other objects and further features of the present invention will be apparent from the following detailed description when read in conjunction with the accompanying drawings.

DESCRIPTION OF THE PREFERRED EMBODIMENTS

Figure 1:
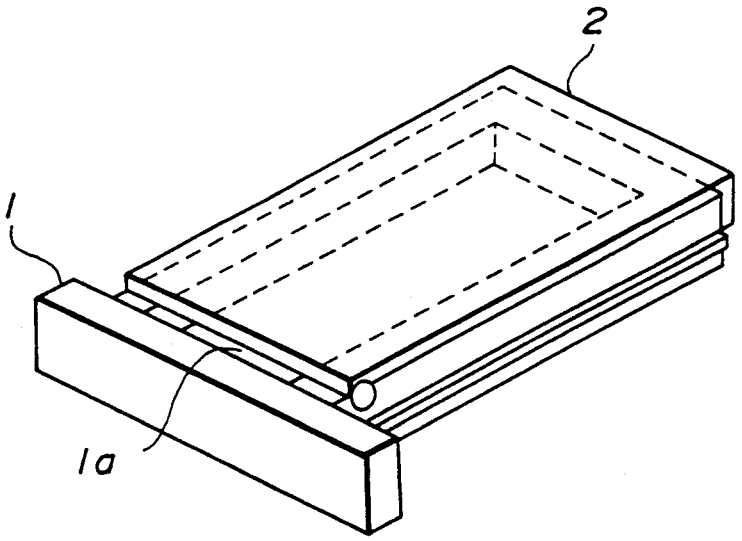
FIG. 1 PRIOR ART
FIG. 1 is a perspective view showing a conventional paper cassette unit.

A description will be given of a first embodiment of the present invention, with reference to FIGS. 2 and 3. FIG. 3 shows an image forming system 3 in which a paper cassette unit 4 is detachably mounted therein, for supplying recording paper to a recording part of the image forming system. The image forming system 3 may be, for example, a copier, a printer, a facsimile machine, or the like. The paper cassette unit 4 holds sheets of paper for use in the image forming system when an image, for example, an image reproduced from an original document, is recorded on the paper. This paper cassette unit 4 includes a front drawer part 5, a paper cassette 7 having a paper compartment 6 in which sheets of paper are accommodated, and a cassette cover 8 for covering an opening 6*a* of the paper compartment 6.

Figure 2:
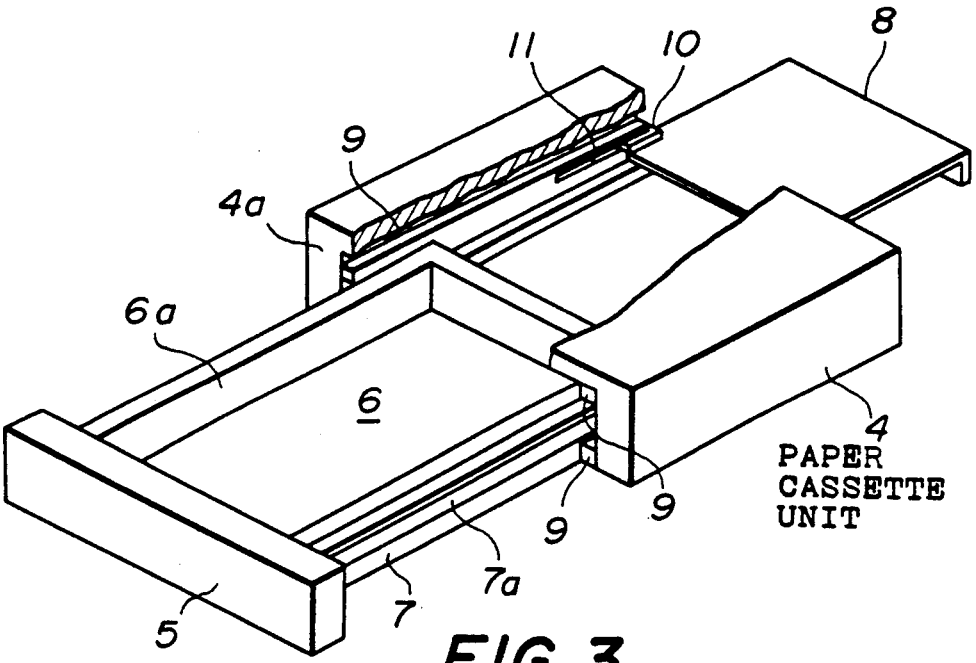
FIG. 2 is a fragmentary view showing a construction of a paper cassette unit in a first embodiment of the present invention.
Figure 3:
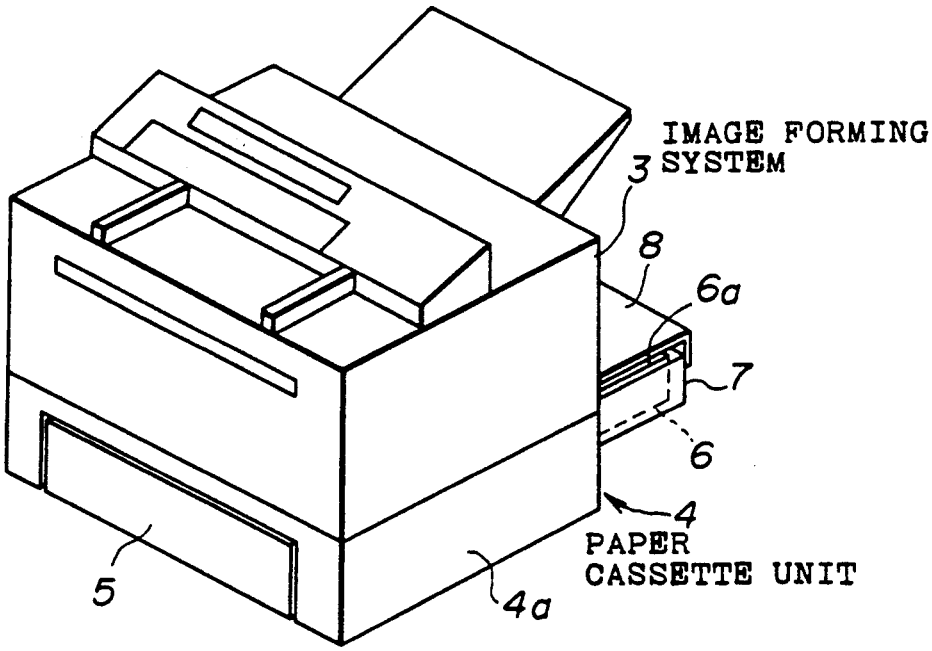
FIG. 3 is a view showing an image forming system in which the paper cassette unit shown in FIG. 2 is mounted.

FIG. 2 shows a structure of a paper cassette unit according to the present invention, which is mounted in the image forming system shown in FIG. 3. In FIG. 2, a paper cassette unit 4 includes a base part 4*a* which has guide rails 9 on both inside surfaces of the base part 4*a*. The paper cassette 7 has two longitudinally extending projections 7*a*, each of which is formed on each side of the paper cassette 7 so that the paper cassette 7 is slidably supported by the guide rails 9 of the base part 4*a* between which the projection 7*a* on each side of the paper cassette 7 is inserted. At a rear portion of each of the guide rails 9 of the base part 4*a*, a guide groove 11 is formed so as to extend longitudinally along the direction of the length of the paper cassette 7. A projecting stopper 10 is provided on each of the side portions of the cassette cover 8. This stopper 10 of the cassette cove 8 is slidably inserted in the guide groove 11 on each of the sides of the base part 4*a*.

Figure 4:
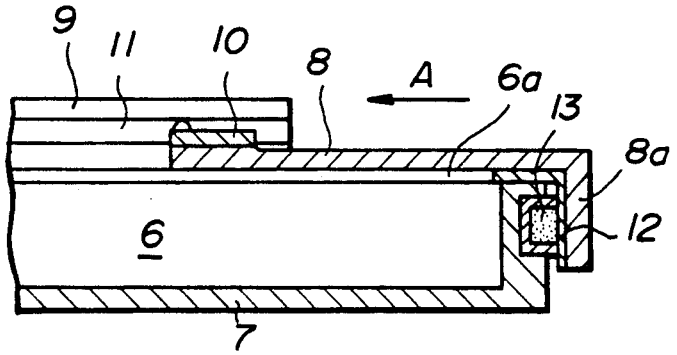
FIG. 4 is a sectional view showing a construction of a side portion of the paper cassette unit show in FIG. 2.

FIG. 4 shows a structure of a side portion of the paper cassette unit including the paper cassette 7 and the cassette cover 8. The cassette cover 8 has at its rear end a vertical bent portion 8*a* on which a metal piece 12 is provided at a portion corresponding to the rear surface of the base part 4*a*. The paper cassette 7 has a magnet 13 on the rear end portion of the paper cassette 7 such that the magnet 13 is opposed to the metal piece 12 of the cassette cover 8.

In the first embodiment, when the paper cassette 7 is mounted in the base part 4*a*, the rear end portion of the paper cassette 7 is snugly fitted to the vertical bent portion 8*a* of the cassette cover 8 owing to the attraction between the magnet 13 and the metal piece 12, and the opening 6*a* of the paper compartment 6 is covered with the cassette cover 8.

When the replenishment or exchange of the paper cassette 7 is necessary, the paper cassette 7 is taken out from the base part 4*a* by pulling the front drawer part 5 in a direction indicated by an arrow A in FIG. 4. The cassette cover 8 initially moves together with the paper cassette 7 in the same direction. However, once the projecting stopper 10 of the cassette cover 8 reaches the end of the guide groove 11 and a pulling force greater than the attracting force between the magnet 13 and the metal piece 12 is applied in the same direction, the paper cassette 7 is separated from the cassette cover 8 so that only the paper cassette 7 moves and is consequently taken out from the base part 4*a*. Thus, the paper cassette 7 can be safely taken out from the base part 4*a* to effect paper replenishment or exchange. The opening 6*a* of the paper compartment 6 is at this time open to the exterior because the cassette cover 8 is separated from the paper cassette 7 and stays in the base part 4*a*. Therefore, it is possible for an operator to safely and easily perform the paper replenishment or exchange with the paper cassette unit of the present invention.

After the replenishment or exchange is done, the paper cassette 7 is again mounted in the base part 4*a*. As shown in FIG. 4, the rear end of the paper cassette 7 is snugly fitted in the vertical bent portion 8*a* of the cassette cover 8 due to the attracting force between the magnet 13 and the metal piece 12 so that the opening 6*a* of the paper compartment 6 is safely covered with the cassette cover 8. The cassette cover 8 is slidably supported by the projecting stopper 10 inserted in the guide groove 11 of the base part 4*a*.

In a modified embodiment of the present invention, it is possible to construct a paper cassette unit in which the paper cassette 7 has at its rear end portion a metal piece 12, and the cassette cover 8 has a magnet 13 such that the magnet 13 is opposed to the metal piece 12.

Figure 5:
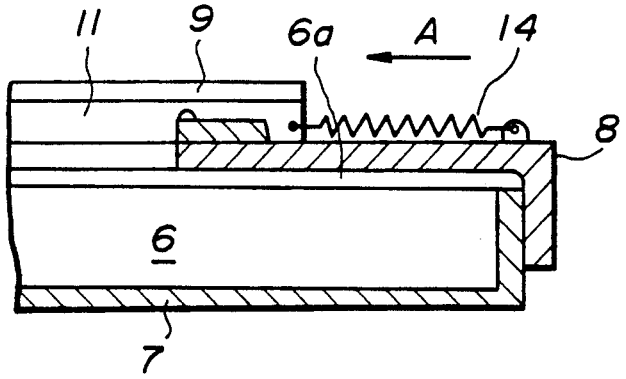
FIG. 5 is a sectional view showing a modified example of the paper cassette unit shown in FIG. 4.

FIG. 5 shows a modified structure of the paper cassette unit in the first embodiment of the present invention. This paper cassette unit uses, instead of the metal piece 12 and magnet 13 described above, a spring member 14 provided for connecting the cassette cover 8 to the base part 4*a*. In this case, when the paper cassette 7 is mounted in the base part 4*a*, the rear end portion of the paper cassette 7 is snugly fitted to the vertical bent portion 8*a* of the cassette cover 8 due to the pulling force of the spring member 14, and the opening 6*a* of the paper compartment 6 is closed by the cassette cover 8.

As described above, in the first embodiment of the present invention, it is not necessary for an operator to detach the cassette cover 8 from the paper cassette 7 after the replenishment or exchange is done, and reattach the cassette cover 8 to the paper cassette 7. It is possible to eliminate the above-mentioned inadvertent operation of an operator in which the operator inadvertently fails to attach the cassette cover to the paper cassette, thus allowing paper in the paper cassette 7 to absorb external moisture.

Figure 6:
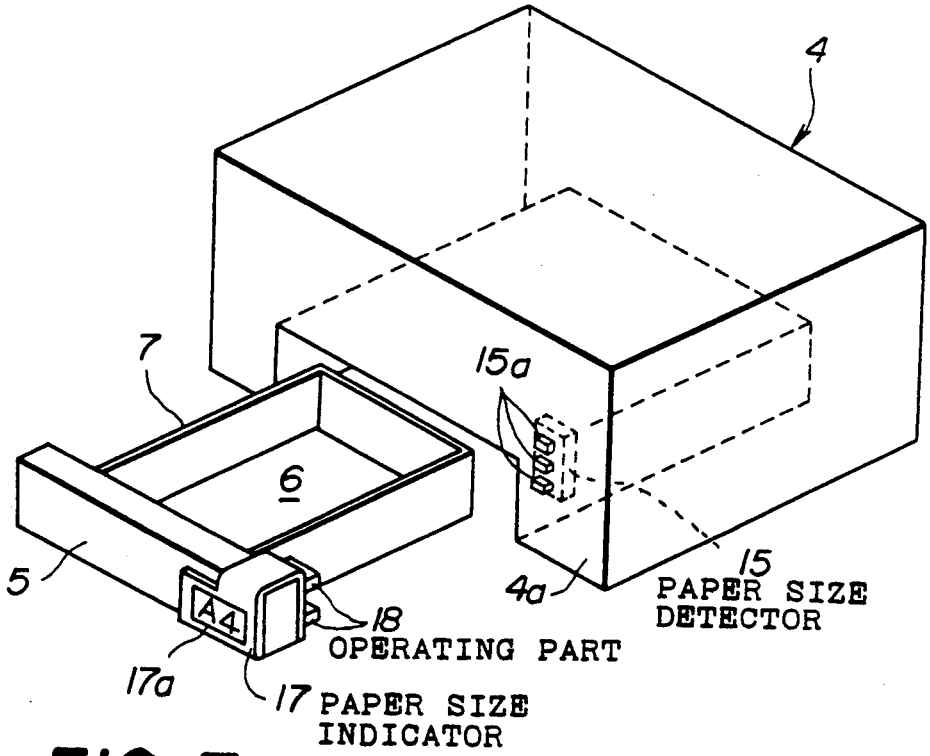
FIG. 6 is a view showing a paper cassette unit in a second embodiment of the present invention.
Figure 7:
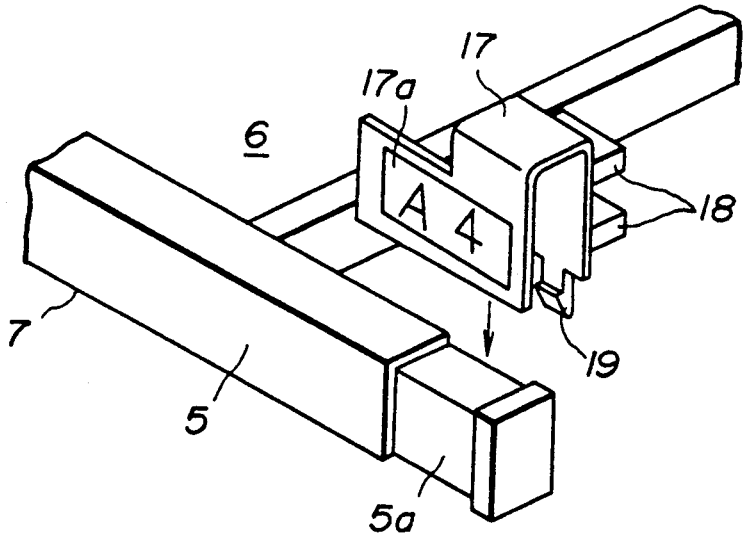
FIG. 7 is a view showing a detailed construction of the paper cassette unit shown in FIG. 6.

FIG. 6 shows a paper cassette unit in a second embodiment of the present invention. FIG. 7 shows a detailed structure of the paper cassette unit shown in FIG. 6. As shown in FIGS. 6 and 7, this paper cassette unit 4 includes a paper-size detector 15 provided on a front surface of the base part 4*a* and having a set of push switches 15*a*, a paper-size indicator 17 being detachably mounted in the front drawer part 5 and having an indication face 17*a* on which a size of paper is indicated (for example, "A4" size is indicated in FIG. 7), an operating part 18 provided on a rear surface of the paper-size indicator 17 and having a set of projections corresponding to the paper size indicated on the indication face 17*a*, and a connecting pawl 19 provided at a bottom end portion of the indicator 17. This connecting pawl 19 is detachably fitted in a recess 5*a* of the front drawer part 5 by means of resilient deformation of the pawl 19. The corresponding projections of the operating part 18 are brought into contact with push switches 15*a* of the paper-size detector 15, and these push switches 15*a* are placed in an ON state.

When the sheets of paper in the paper cassette unit 4 shown in FIG. 6 are replaced with new sheets of paper of a different size, the paper cassette 7 is taken out from the base part 4*a* by pulling the front drawer part 5. Similar to the above first embodiment, it is possible to automatically detach the cassette cover 8 from the paper cassette 7 when it is taken out from the base part 4*a*. The cassette cover 8 of this embodiment is not taken out from the base part 4*a* but stays in the base part 4*a* by means of a projecting stopper, provided on the cassette cover for connecting the projecting stopper to the end of a guide groove, which is similar to the projecting stopper 10 shown in FIG. 2 in the first embodiment. Also, the paper-size indicator 17 which was previously fitted in the recess 5*a* of the front drawer part 5 is replaced by another paper-size indicator of the same construction having an indication face on which a paper size corresponding to new sheets of paper is indicated.

The new sheets of paper are loaded into the paper compartment 6, and the paper cassette 7 is inserted into the base part 4*a*. The operating part 18 on the rear portion of the paper size indicator 17 comes in contact, and the projections of the operating part 18 press corresponding push switches 15*a* of the detector 15 so that the push switches 15*a* are placed in an ON state. For example, in a case where the operating part 18 has top and bottom projections and the paper size detector 15 has top, center and bottom push switches 15*a*, only the top and bottom push switches of the detector 15 are depressed and placed in the ON state. A detection signal indicative of the paper size is generated based on a combination of the depressed push switches 15*a* placed in the ON state. This detection signal is supplied by the paper-size detector 15 to a control part of the image forming system so that a new paper size after the paper replacement is effected can be detected by the image forming system. In such a manner, the size of paper can be detected based on a combination of the depressed push switches 15*a* of the detector 15. The push switches of the paper-size detector 15 are partly depressed by corresponding projections of the operating part 18 and they are placed in the ON state, while the remaining switches are not contacted by the operating part 18 and remain in an OFF state.

In the second embodiment, it is possible to accurately detect the size of paper contained in the paper cassette unit 4 by performing a simple task of changing the paper-size indicator 17 because the operating part 18 is formed integrally with the paper-size indicator 17. Also, different sizes of paper can be accommodated in the paper cassette by using only one paper cassette unit. The same paper cassette unit can be used in common by simply attaching or replacing the paper-size indicator 17 corresponding to the size of paper accommodated in the paper cassette.

Further, the present invention is not limited to the above described embodiments, and variations and modifications may be made without departing from the scope of the present invention.

What is claimed is:

1. A paper cassette unit provided within an image forming system, said paper cassette unit comprising:

a base part which is installed in the image forming system;

a paper cassette having a paper compartment in which sheets of paper are accommodated for use in the image forming system, said paper cassette being detachably mounted in the base part;

a cassette cover for covering an opening of the paper compartment when the paper cassette is mounted in the base part; and means for connecting said cassette cover to the base part in such a way that said cassette cover stays in the base part when the paper cassette is demounted from the base part, said connecting means comprising a stopper provided on the cassette cover and a guide groove formed in the base part, said guide groove having an end at an intermediate portion of the base part, said cassette cover being slidably supported in the guide groove in such a way that only the paper cassette is moved along the guide groove, and the cassette cover staying in the base part when the paper cassette is demounted from the base part and the stopper reaches said end of said guide groove.

2. A paper cassette unit as claimed in claim 1, wherein said cassette cover includes a vertical end wall on which a metal piece is provided, and said paper cassette includes a magnet at a rear end portion of the paper cassette corresponding to the metal piece on the cassette cover, so that said vertical end wall of the cassette cover is snugly fitted to said rear end portion of the paper cassette due to an attracting force between the magnet and the metal piece when the paper cassette is mounted in the base part.

3. A paper cassette unit as claimed in claim 1, wherein said cassette cover includes a vertical end wall on which a magnet is provided, and said paper cassette includes a metal piece at a rear end portion of the paper cassette corresponding to the magnet on the cassette cover in such a way that, when the paper cassette is mounted in the base part, said vertical end wall of the cassette cover is snugly fitted to said rear end portion of the paper cassette due to an attracting force between the magnet and the metal piece.

4. A paper cassette unit as claimed in claim 1, wherein said cassette cover includes a vertical end wall and a spring member which resiliently connects the cassette cover to the base part in such a way that, when the paper cassette is mounted in the base part, the vertical end wall of the cassette cover is snugly fitted to a rear end portion of the paper cassette due to a resilient force of said spring member.

5. A paper cassette unit as claimed in claim 1, comprising:

a size indicator for indicating size of the sheets of paper in the paper cassette, said size indicator being detachably mounted in the paper cassette and having an integrally formed operating part including a set of projections corresponding to the size indicated by the size indicator; and detection means for detecting the size of the sheets of paper in the paper cassette, said detection means having a set of switches being depressed by the projections of the operation part when the paper cassette is mounted in the base part.

6. A paper cassette unit as claimed in claim 5, wherein said detection means includes a set of push switches which are depressed by corresponding projections of the operating part when the paper cassette is mounted in the base part, the size of the sheets of paper in the paper cassette thus being detected based on a combination of said depressed push switches included in said detection means.

7. A paper cassette unit as claimed in claim 5, wherein said detection means supplies a detection signal indicative of said paper size to a control part of the image forming system when the paper cassette is mounted in the base part, said control part detecting said paper size based on said detection signal received from the detection means.

* * * * *